US012037156B2

(12) United States Patent
Ferris et al.

(10) Patent No.: US 12,037,156 B2
(45) Date of Patent: Jul. 16, 2024

(54) APPARATUS AND METHODS FOR PRODUCING TUBULAR PACKAGES

(71) Applicant: INTERCONTINENTAL GREAT BRANDS LLC, East Hanover, NJ (US)

(72) Inventors: Kevin Ferris, Bournville (GB); Daniel Bortos, Loerrach (DE); Leesha Muman, Bournville (GB)

(73) Assignee: INTERCONTINENTAL GREAT BRANDS LLC, East Hanover, NJ (US)

( * ) Notice: Subject to any disclaimer, the term of this patent is extended or adjusted under 35 U.S.C. 154(b) by 161 days.

(21) Appl. No.: 17/291,589

(22) PCT Filed: Feb. 4, 2020

(86) PCT No.: PCT/IB2020/000035

§ 371 (c)(1),
(2) Date: May 5, 2021

(87) PCT Pub. No.: WO2020/174277

PCT Pub. Date: Sep. 3, 2020

(65) Prior Publication Data

US 2021/0403185 A1 Dec. 30, 2021

(30) Foreign Application Priority Data

Feb. 27, 2019 (GB) ..... 1902604

(51) Int. Cl.
*B65B 9/087* (2012.01)
*B65B 9/06* (2012.01)

(52) U.S. Cl.
CPC ..... *B65B 9/087* (2013.01); *B65B 2009/063* (2013.01); *B65B 2220/08* (2013.01)

(58) Field of Classification Search
CPC ..... B65B 9/087; B65B 2009/063; B65B 2220/08; B65B 9/067; B65B 9/06
(Continued)

(56) References Cited

U.S. PATENT DOCUMENTS 3,335,540 A 8/1967 Wilhelm et al.
3,532,516 A * 10/1970 Erekson ..... B65B 9/06 53/550

(Continued)

FOREIGN PATENT DOCUMENTS

EP 0084299 A1 7/1983
EP 0119957 A1 9/1984

(Continued)

OTHER PUBLICATIONS

International Search Report for International Application No. PCT/IB2020/000033; International Filing Date: Feb. 4, 2020; Date of Mailing: Apr. 21, 2020; 4 pages.

(Continued)

*Primary Examiner* — Veronica Martin
(74) *Attorney, Agent, or Firm* — CANTOR COLBURN LLP

(57) ABSTRACT

Apparatus (10) for producing tubular packages includes a packaging material dispenser (12) and a forming section (20). The forming section (20) comprises a series of package formers (22*a*-22*e*) aligned in the machine direction, each defining a packaging material folding channel (24) through which the packaging material passes. The channels (24) of the package formers in the series vary in shape such that as the packaging material passes through the forming section it is gradually folded about a longitudinal axis from a planar configuration into a tubular structure. A series of items (44) to be packaged is conveyed in the machine direction and may be sequentially introduced proximal to the packaging material (14) at a location such that the packaging material is subsequently folded about each item in turn as it continues through the forming section. The apparatus may be a horizontal or vertical form, fill seal type apparatus. The pack- (Continued)

aging material (14) may be a semi-rigid packaging material such as paperboard, cartonboard, or semi-rigid plastics.

22 Claims, 8 Drawing Sheets

(58) Field of Classification Search
USPC ..... 53/550, 450
See application file for complete search history.

(56) References Cited

U.S. PATENT DOCUMENTS

| | | | | |
|---|---|---|---|---|
| 3,716,962 | A | 2/1973 | Topler et al. | |
| 4,587,794 | A | 5/1986 | Kopp | |
| 4,603,536 | A * | 8/1986 | de la Poype | B65B 9/20 53/410 |
| 4,640,081 | A | 2/1987 | Kawaguchi et al. | |
| 6,574,944 | B2 | 6/2003 | Capodieci | |
| 6,986,236 | B2 | 1/2006 | Schneider et al. | |
| 7,269,559 | B2 | 9/2007 | Kondo et al. | |
| 7,694,499 | B2 | 4/2010 | Ballestrazzi et al. | |
| 2002/0194816 | A1 | 12/2002 | Schneider et al. | |
| 2004/0173492 | A1 | 9/2004 | Kane et al. | |
| 2013/0097965 | A1* | 4/2013 | Honegger | B65B 9/10 53/204 |

FOREIGN PATENT DOCUMENTS

| | | | |
|---|---|---|---|
| EP | 3072821 | A1 | 9/2016 |
| JP | 06191528 | A | 7/1994 |
| JP | 4857468 | B2 | 1/2012 |

OTHER PUBLICATIONS

International Search Report for International Application No. PCT/IB2020/000035; International Filing Date: Feb. 4, 2020; Date of Mailing: May 27, 2020; 3 pages.
Written Opinion for International Application No. PCT/IB2020/000033; International Filing Date: Feb. 4, 2020; Date of Mailing: Apr. 21, 2020; 7 pages.
Written Opinion for International Application No. PCT/IB2020/000035; International Filing Date: Feb. 4, 2020; Date of Mailing: May 27, 2020; 7 pages.
Japanese Office Action issued in Japanese Patent Application No. 2021-546270, date of drafting Jul. 26, 2022 (English Translation).
Non-Final Office Action issued in U.S. Appl. No. 17/291,602 dated Sep. 28, 2023, 29 pages.

* cited by examiner

APPARATUS AND METHODS FOR PRODUCING TUBULAR PACKAGES

CROSS REFERENCE TO RELATED APPLICATIONS

This application is a National Stage application of PCT/IB2020/000035, filed Feb. 4, 2020, which claims the benefit of GB Application No. 1902604.6, filed Feb. 27, 2019, both of which are incorporated by reference in their entirety herein.

TECHNICAL FIELD OF THE INVENTION

The present invention relates to apparatus and methods for packaging. The apparatus and methods are especially, but not exclusively, suitable for packaging items in tubular packaging made from a semi-rigid packaging material, such as paperboard, cartonboard, and semi-rigid plastic, in a substantially continuous process.

BACKGROUND TO THE INVENTION

It is known to provide so-called flow-wrap packaging which consists of a flexible tubular container sealed at either end, normally with crimping or embossing to provide patterned sealing portions.

In general, this type of flow-wrap packaging is manufactured by horizontal or vertical form, fill and seal processes (HFFS or VFFS). In HFFS processes, a flexible packaging film is run through machinery which folds the material around an item and then clamps and seals the ends of the folded material followed by cutting, to provide a sealed packaging. Such packaging can be run through appropriate machinery relatively rapidly, in order to produce many filled packages per minute. Examples of such machinery include the Pack 401 Horizontal Flow Wrapper supplied by Bosch GmbH, Germany and the Horizontal Form Fill Seal Packaging Machine 8000 MH supplied by Ossid, USA.

The flexible films conventionally used for flow-wrap packaging generally comprise polymeric materials and are relatively strong, resistant to tearing, highly flexible, and with low dead-fold properties. The known HFFS or VFFS processes and apparatus have been developed to take advantage of these characteristics in wrapping the film about the item being packed and sealing the package. In a typical arrangement, a continuous length of film is drawn from a roll on to a former. The film engages the former on one side and is drawn along the former conforming to its shape. The shape of the former gradually changes along its length and is configured so that the film is directed to move in the machine direction and folded into a tube-like structure as it passes over the former. The item being packaged is introduced into the partially folded packaging film so that the film is wrapped about the item and overlapping, longitudinally extending lateral edge regions are sealed together to form a longitudinal seal. Opposed regions of the film are sealed together at either end of the item to form transverse end seals and each package is cut to separate it from the length of film. In some arrangements, it is the inner surface of the film (that is to say the surface which is directed toward the item once the packaging is formed) that engages with the shaped former whilst in others it is the outer surface of the film which engages the former.

The known HFFS flow-wrap arrangements are particularly suitable for packaging items or articles that are substantially rigid. Products such as candy and chocolate bars and other food products which are rigid at the temperatures encountered during packaging are often packaged in this manner. Flowable products can also be flow-wrapped using HFFS arrangements if they are first placed in a generally rigid inner container and the flow-wrapped package formed about the filled container. The term "rigid" in this context should be understood as meaning that the item maintains its shape during packaging rather than being flowable. Looked at another way, it can be said that "rigid" items are generally dimensionally stable during packaging.

In a typical HFFS arrangement, the film is drawn down on to the former from above at an oblique angle to the horizontal and the former turns the material on to a horizontal flow path whilst also folding it about the item being packaged. This requires the material to be folded in multiple directions or planes at the same time. Whilst this achievable with the highly flexible polymeric films typically used in flow-wrap packaging, it presents difficulties with semi-rigid materials having greater dead-fold properties as the material will tend to bulge and crease undesirably if folded by a significant amount in more than one direction or plane at the same time.

It would therefore be advantageous to provide apparatus for packaging a series of items in packages produced sequentially from a substantially continuous length of packaging material suitable for use with a broader range of packaging materials.

It would be particularly advantageous to provide apparatus for packaging a series of items in packages produced sequentially from a substantially continuous length of packaging material suitable for use with packaging materials comprising paperboard, cartonboard, semi-rigid plastics or other semi-rigid packaging materials.

It would also be advantageous to provide a method of packaging a series of items in packages produced sequentially from a substantially continuous length of packaging material suitable for use with a broader range of packaging materials.

It would be particularly advantageous to provide a method of packaging a series of items in packages produced sequentially from a substantially continuous length of packaging material suitable for use with packaging materials comprising paperboard, cartonboard, semi-rigid plastics or other semi-rigid packaging materials.

It is therefore an aim of embodiments of the present invention to overcome or mitigate at least some of the problems of the prior art.

SUMMARY OF THE INVENTION

Aspects of the invention relate to apparatus and methods for packaging items or articles.

In accordance with one aspect of the invention, there is provided apparatus for producing tubular packages sequentially from an initially generally flat, substantially continuous length of packaging material, each package enclosing one of a series of items which are conveyed through the apparatus in a machine direction, the apparatus comprising:

a) a packaging material dispenser arranged to dispense a substantially continuous length of packaging material and convey the packaging material in the machine direction, in use;

b) a package forming section including a series of package formers arranged in the machine direction, each package former defining a packaging material folding channel through which the packaging material is conveyed, in use;

wherein the packaging material folding channels of the package formers in the series vary in shape such that, in use, packaging material passing through the series of package formers is gradually (sequentially) folded to form a tube-like structure.

Terms such as "fold", "folding", and the like as used herein in relation to the packaging material should be understood as encompassing arrangements in which the packaging material is wrapped, bent or turned but which do not necessarily produce crease lines in the material unless the requirement for a crease line is explicitly stated.

The apparatus may be configured for use in manufacturing packaging from semi-rigid packaging material. The term "semi-rigid" refers to or includes a material which can be folded about an item during packaging but which is sufficiently rigid that it exhibits dead-fold characteristics. The apparatus may be configured for use in manufacturing packaging from semi-rigid materials such as paperboard, cartonboard, cardboard, or semi-rigid polymeric materials, including combinations of such materials and laminated materials which include at least one layer of such materials. Where the packaging material is cartonboard, it may comprise multiple layers of fibres and may comprise at least three layers of fibres. The apparatus may be configured for use in manufacturing packaging from packaging material comprising paperboard or cartonboard having a weight of 150 g/sqm or more. The apparatus may be configured for use in manufacturing packaging from packaging material comprising paperboard or cartonboard having a weight in the range of 150 g/sqm to 250 g/sqm. Where the apparatus is configured for use in manufacturing packaging from semi-rigid polymeric materials, it may be configured for use in manufacturing packaging from a semi-rigid polymeric material having a thickness of 150 μm or more, or a thickness of 200 μm or more. The apparatus may be configured for use in manufacturing packaging from packaging material which is coated or otherwise provided with adhesive or other material for producing seals, such as a heat sealing layer. The apparatus may be configured for use in manufacturing packaging from packaging material which is printed on and/or coated in a protective layer. The apparatus may be configured for use in manufacturing packaging from packaging material which includes a metal or metallised layer and/or a barrier layer.

In apparatus in accordance with the invention, the packaging material is folded from a planar configuration incrementally by the package formers in the series. The use of a series of formers is advantageous as it is easier to manufacture and set up, is easier to clean, and leads to a reduction in friction compared to a former having a continuous broad surface over which the packaging material is drawn. For use with semi-rigid packaging materials, such as paperboard or cartonboard, it is expected the folding operation will be carried out over a greater distance than is the case with conventional HFFS or VFFS apparatus. Accordingly, in apparatus in accordance with the invention, the forming section may extend over a length as measured in the machine direction of 1 m or more, or 1.5 m or more, or 2 m or more or 3 m or more. Alternatively, the forming section may extend over a length as measured in the machine direction which is at least 3 times the length of the package the apparatus is configured to produce, or at least 4 times the length of the package the apparatus is configured to produce, or at least 5 times the length of the package the apparatus is configured to produce, or at least 6 times the length of the package the apparatus is configured to produce, where the length of the package is measured in the machine direction. Alternatively, the forming section may extend over a length as measured in the machine direction which is at least 7 times the width of the package the apparatus is configured to produce, or at least 8 times the width of the package the apparatus is configured to produce, or at least 9 times the width of the package the apparatus is configured to produce, or at least 10 times the width of the package the apparatus is configured to produce, where the width of the package is measured in a lateral direction, transverse to the machine direction.

In an embodiment, the package formers are configured such that the packaging material is folded about a longitudinal axis X extending in the machine direction. The packaging material dispenser may be configured so that the packaging material is brought onto a first of the package formers in the series in a direction generally parallel to a plane extending parallel to, or which contains, the longitudinal axis X. The packaging material dispenser may be configured so that the packaging material is brought onto a first of the package formers in the series in a direction which is angled at no more than twenty degrees, or no more than ten degrees, or no more than five degrees, relative to a plane extending parallel to, or which contains, the longitudinal axis X. In an embodiment where the longitudinal axis X is generally horizontal, the packaging material dispenser may be configured so that the packaging material is brought onto a first of the package formers in the series in a direction which is inclined at no more than twenty degrees, or no more than ten degrees, or no more than five degrees, relative to the horizontal. The packaging material may be inclined upwardly onto the first of the package formers in the series. The apparatus may be configured such that the packaging material (or at least part of the packaging material) passes through the entire forming section (e.g. through all of the package formers in the series) in a substantially common plane. The packaging material folding channels of the package formers may be aligned concentrically along said longitudinal axis.

In an embodiment, at least one of the package formers in the series is configured to engage both an outer and an inner surface of the packaging material as it passes through the packaging material folding channel. In an embodiment, each of the package formers in the series is configured to engage both an outer and an inner surface of the packaging material as it passes through the packaging material folding channel. In another embodiment, each package formers in the series, apart from a final one of the series, is configured to engage both an outer and an inner surface of the packaging material as it passes through the packaging material folding channel.

In an embodiment, the apparatus further comprises an item conveyancing arrangement for conveying a series of items to be packaged in the machine direction and sequentially positioning each item proximal to the packaging material at a location such that, in use, the packaging material is subsequently folded about the item. In an embodiment, the item conveyancing arrangement is configured to insert each item into the partially folded packaging material at a location upstream of at least one of the package formers in the series. In one embodiment, said location is upstream of a first one of the package formers. In an alternative embodiment, said location is downstream of at least a first one of the package formers and upstream of at least a last one of the package formers in the series. The apparatus may be configured such that, in use, each item is conveyed together with the packaging material through the packaging material folding channel of the, or each, of the package formers downstream of said location. The packaging material folding channels of the package formers in the series downstream of said location may be shaped to accommodate an item to be packed at least partially surrounded by the packaging material. The item conveyancing arrangement may comprise one or more elongate item support members extending generally in the machine direction and configured for supporting an item being packaged. The one or more elongate item support members may be positioned so as to extend within the partially folded packaging material in use.

The forming section may be configured to fold the packaging material into a tube-like structure with longitudinally extending lateral edge regions of the material overlapping and the apparatus may comprise a sealing arrangement for sealing together the opposed lateral edge regions of the material to form a longitudinal seal in use. In an embodiment, the forming section is configured to fold the packaging material into a tube-like structure with longitudinally extending lateral edge regions of the material projecting in opposed relation so as to form a fin type seal. In an alternative embodiment, the forming section is configured to fold the packaging material into a tube-like structure with longitudinally extending lateral edge regions of the material overlapping so as to form a lap type seal.

At least some of the package formers, or at least those parts of them that contact the packaging material in use, may be spaced apart from one another in the conveyance/machine direction. The spacing may not be equi-distant throughout the series. The spacing between at least two adjacent package formers in the series may be adjustable. Accordingly, at least one of the package formers may be adjustable in a direction parallel to the machine direction. At least one of the package formers may be adjustable to vary the position of its packaging material folding channel in a direction perpendicular to the machine direction and/or the angle of the packaging material folding channel relative to that of the packaging material folding channel of at least one other of the package formers. Where the machine direction is aligned substantially horizontally, at least one of the package formers may be adjustable to vary the height of its packaging material folding channel relative to that of at least one other of the package formers. At least one of the package formers may be adjustably mounted to a support. Some or all of the package formers may be adjustably mounted to a common support. At least some of the package formers may be separate components.

At least one of the package formers may comprise a body in which the packaging material folding channel is defined at least in part by means of an aperture through the body. In an embodiment, the body may be a plate. At least one of the package formers may be provided with at least one guide for guiding the packaging material into or out of the aperture. Said at least one of the package formers may be provided with an outer guide for contacting an outer surface of the packaging material and/or an inner guide for contacting an inner surface of the packaging material.

In an alternative embodiment, at least one of the package formers may comprise two separate members profiled and spaced apart to define the packaging material folding channel between them.

At least one of the package formers could be provided with low friction inserts or rollers or other formations or be coated with a low friction material.

The shape of the packaging material folding channel may vary in the conveyance direction in at least one of the package formers.

The apparatus may comprise an arrangement for scoring, debossing and/or pre-creasing the packaging material. At least one of the package formers may include tooling for scoring and/or debossing the packaging material. Alternatively, or in addition, an arrangement for scoring, debossing and/or pre-creasing the packaging material may be provided in-line in the apparatus, upstream of any one of the package formers. An arrangement for scoring the packaging material may comprise mechanical die cutting and/or laser scoring technology. An arrangement for debossing the packaging material may comprise mechanical pressing technology.

In an embodiment, the apparatus includes an arrangement for moistening and/or heating the packaging material. This may comprise apparatus for applying steam and/or moist hot air to the packaging material. In an embodiment, at least some of the package formers are housed in a chamber and the apparatus includes a system for injecting steam and/or moist hot air into the chamber. In an embodiment, a pre-treatment chamber for moistening the packaging material is provided upstream of the package formers through which the packaging material is conveyed before passing through the package formers. In an embodiment, the apparatus comprises one or more nozzles for directing steam and/or moist hot air on to the packaging material. At least one of the package formers may incorporate a heating arrangement for heating the packaging material in use.

The apparatus may be configured for use in packaging items which are rigid.

The apparatus may be adapted for use in packaging items in a range of shapes, including items which are prismatic in shape, such as block-shaped products in the form of bars, which might include candy bars, chocolate bars, and other snack type bars or food products, for example. The apparatus may be adapted for use in packaging items having irregular shapes.

The apparatus may be adapted for use in packaging items comprising product placed in a rigid container. This could comprise flowable (e.g. non-rigid) product placed in a container or a plurality of rigid products grouped together in a container. For example, the apparatus may be adapted to package a plurality of products arranged in a stack in a rigid container. Such products may comprise cakes, biscuits, other foodstuff and the like.

The apparatus may be configured to package an item comprising more than one product piece.

The apparatus may be a horizontal, form, fill and seal apparatus.

The apparatus may be a vertical, form, fill and seal apparatus.

In accordance with another aspect of the invention, there is provided a method of manufacturing tubular packages sequentially from an initially generally flat, substantially continuous length of packaging material, each package enclosing one of a series of items which are conveyed in a machine direction, the method comprising:

a) dispensing a substantially continuous length of packaging material and conveying the packaging material in the machine direction;

b) folding the packaging material into a tube-like structure by passing it through a forming section including a series of package formers arranged in the machine direction, each package former comprising a packaging material folding channel through which the packaging material is conveyed;

wherein the packaging material folding channels of the package formers in the series vary in shape so as to gradually fold the packaging material about a longitudinal axis extending in the machine direction.

The packaging material folding channels of the package formers in the series may be configured so as to gradually (sequentially) fold the packaging material about the longitudinal axis into a tube-like structure.

The packaging material may be a semi-rigid material. The term "semi-rigid" refers to or includes a material which can be folded about an item during packaging but which is sufficiently rigid that it exhibits dead-fold characteristics. The packaging material may comprise any one or more selected from the group comprising: paperboard, cartonboard, cardboard, or a semi-rigid polymeric material. Where the packaging material is cartonboard, it may comprise multiple layers of fibres and may comprise at least three layers of fibres. The packaging material may comprise paperboard or cartonboard having a weight of 150 g/sqm or more. The packaging material may comprise paperboard or cartonboard having a weight in the range of 150 g/sqm to 250 g/sqm. Alternatively, where the packaging material is a semi-rigid polymeric material it may have a thickness of 150 μm or more, or a thickness of 200 μm or more. The packaging material may be coated or otherwise provided with adhesive or other material for producing seals, such as a heat sealing layer. The packaging material may be printed on and/or coated in a protective layer. The packaging material may include a metal or metallised layer and/or a barrier layer.

The method may comprise folding the packaging material from a substantially planar configuration into a tube-like structure over a distance measured the machine direction of 1 m or more, or 1.5 m or more, or 2 m or more or 3 m or more. Alternatively, the method may comprise folding the packaging material from a substantially planar configuration into a tube-like structure over a distance measured the machine direction which is at least 3 times the length of the package, or at least 4 times the length of the package, or at least 5 times the length of the package, or at least 6 times the length of the package. In a further alternative, the method may comprise folding the packaging material from a substantially planar configuration into a tube-like structure over a distance measured the machine direction which is at least 7 times the width of the package, or at least 8 times the width of the package, or at least 9 times the width of the package, or at least 10 times the width of the package.

In an embodiment, at least one of the package formers in the series contacts both an outer surface and an inner surface of the packaging material as it passes through the packaging material folding channel. In an embodiment, each of the package formers in the series contact both an outer surface and an inner surface of the packaging material as it passes through their respective packaging material folding channels. In an embodiment, each of the package formers apart from a last one in the series contact both an outer surface and an inner surface of the packaging material as it passes through their respective packaging material folding channels.

The method may comprise bringing the packaging material onto a first of the package formers in the series in a direction generally parallel to a plane extending parallel to, or which contains, said longitudinal axis X. The method may comprise bringing the packaging material onto a first of the package formers in the series in a direction which is angled at no more than twenty degrees, or no more than ten degrees, or no more than five degrees, relative to a plane extending parallel to, or which contains, said longitudinal axis X. In an embodiment where the machine direction is generally horizontal, the method may comprise bringing the packaging material onto a first of the package formers in the series in a direction which is inclined at no more than twenty degrees, or no more than ten degrees, or no more than five degrees, relative to the horizontal. The method may comprise angling the package material upwardly on to the first of the package formers in the series. The method may comprise aligning the packaging material folding channels of the package formers substantially concentric to said longitudinal axis X and/or in a common plane.

The method may comprise sequentially introducing items to be packaged into the partially folded packaging material upstream of at least one of the package formers and subsequently passing each of said items together with the partially folded packaging material through the packaging material folding channel of said at least one of the package formers to fold the packaging material around the item. In an embodiment, the method comprises introducing said items into the partially folded packaging material at a location upstream of a first one of the package formers in the series so that each of said items is passed together with the partially folded packaging material through the packaging material folding channel of each of the package formers in the series. In an alternative embodiment, the method comprises introducing said items into the partially folded packaging material at a location downstream of at least a first one of the package formers in the series so that each of said items is passed together with the partially folded packaging material through the packaging material folding channel of each of the package formers in the series downstream of said location. In this embodiment, the items may each be introduced into the partially folded packaging material at a location where parts of the packaging material have been folded to a position in which they are located below the item.

The items may be rigid items. The method may comprise folding the packaging material about each of the items in turn. The method may comprise folding the packaging material about each of the items in turn so that it conforms to the cross-sectional shape of the item. The method may be configured for use in packaging items in a range of shapes, including items which are prismatic in shape, such as block-shaped items in the form of bars, which might include candy bars, chocolate bars, and other snack type bars. The method may be adapted for use in packaging items having irregular shapes. Each item may comprise more than one product piece. Each item may comprise a rigid container into which product has been introduced.

An item may comprise product held in a rigid container. This could comprise flowable (e.g. non-rigid) product placed in a container or a plurality of rigid products grouped together in a container. For example, the method may be adapted to package a plurality of products arranged in a stack in a rigid container. Such products may comprise biscuits or the like.

The method may be carried out on a horizontal, form, fill and seal apparatus.

The method may be carried out on a vertical, form, fill and seal apparatus.

The method may comprise sealing opposed lateral edge regions of the packaging material together to form a longitudinal seal after the material has been wrapped about each item. The method may comprise forming a fin type seal or a lap type longitudinal seal.

The method may comprise sealing opposed portions of the packaging material together at either end of an item after it has been wrapped in the packaging material to form transverse end seals.

The method may comprise scoring, debossing, and/or pre-creasing the material.

The method may comprise treating the packaging material with moisture and/or heating the packaging material. The method may comprise treating the packaging material with steam and/or hot moist air.

The method may comprise forming seals in the package using ultrasonic and/or radio frequency sealing techniques.

The method may be carried out using apparatus according to the first aspect of the invention as set out above.

A still further aspect of the invention relates to the use of apparatus according to the first aspect of the invention as set out above to carry out the method according to the second aspect of the invention as set out above.

DETAILED DESCRIPTION OF THE INVENTION

In order that the invention may be more clearly understood several embodiments thereof will now be described, by way of example only, with reference to the accompanying drawings, in which.

In the following description, features which are the same or which perform the same function in the various embodiments have been given the same reference numeral but increased by 100 in each case.

Figure 1:
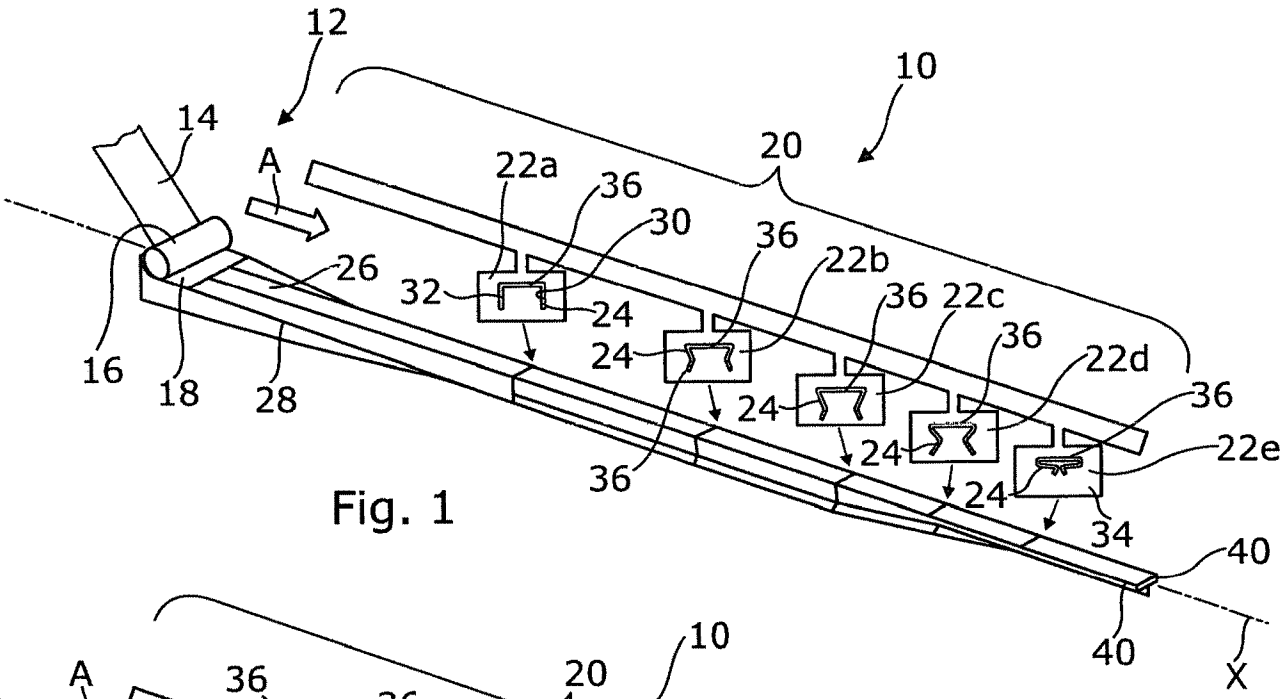
FIG. 1 is a schematic illustration of an embodiment of apparatus for manufacturing packaging in accordance with an aspect of the present invention.
Figure 2:
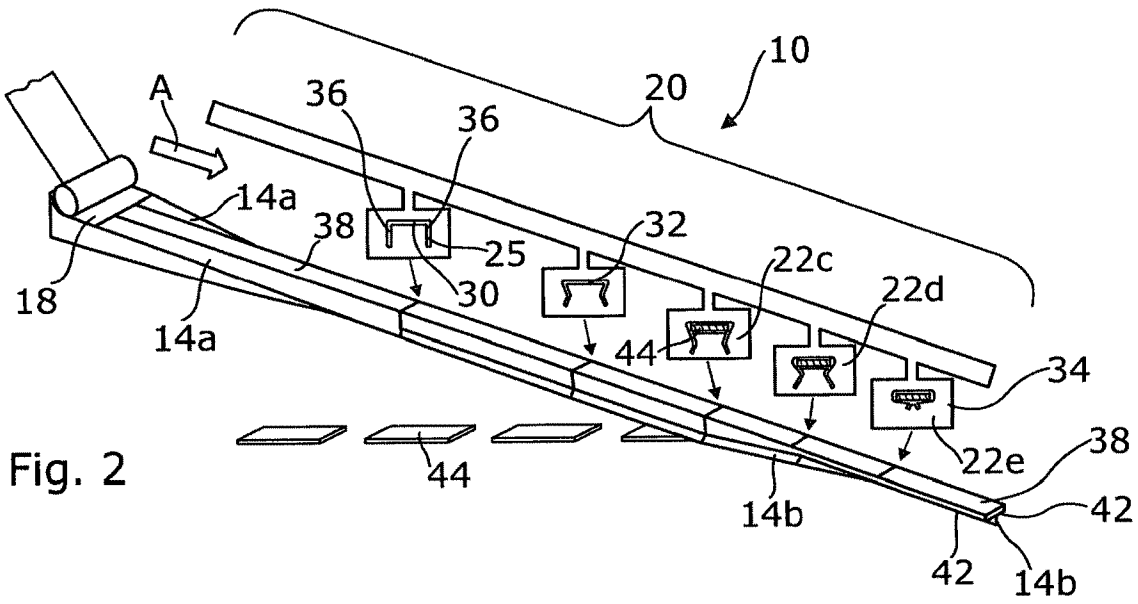
FIG. 2 is a further schematic illustration of the apparatus of FIG. 1 exemplifying a first embodiment of an arrangement for introducing items into the packaging.
Figure 3:
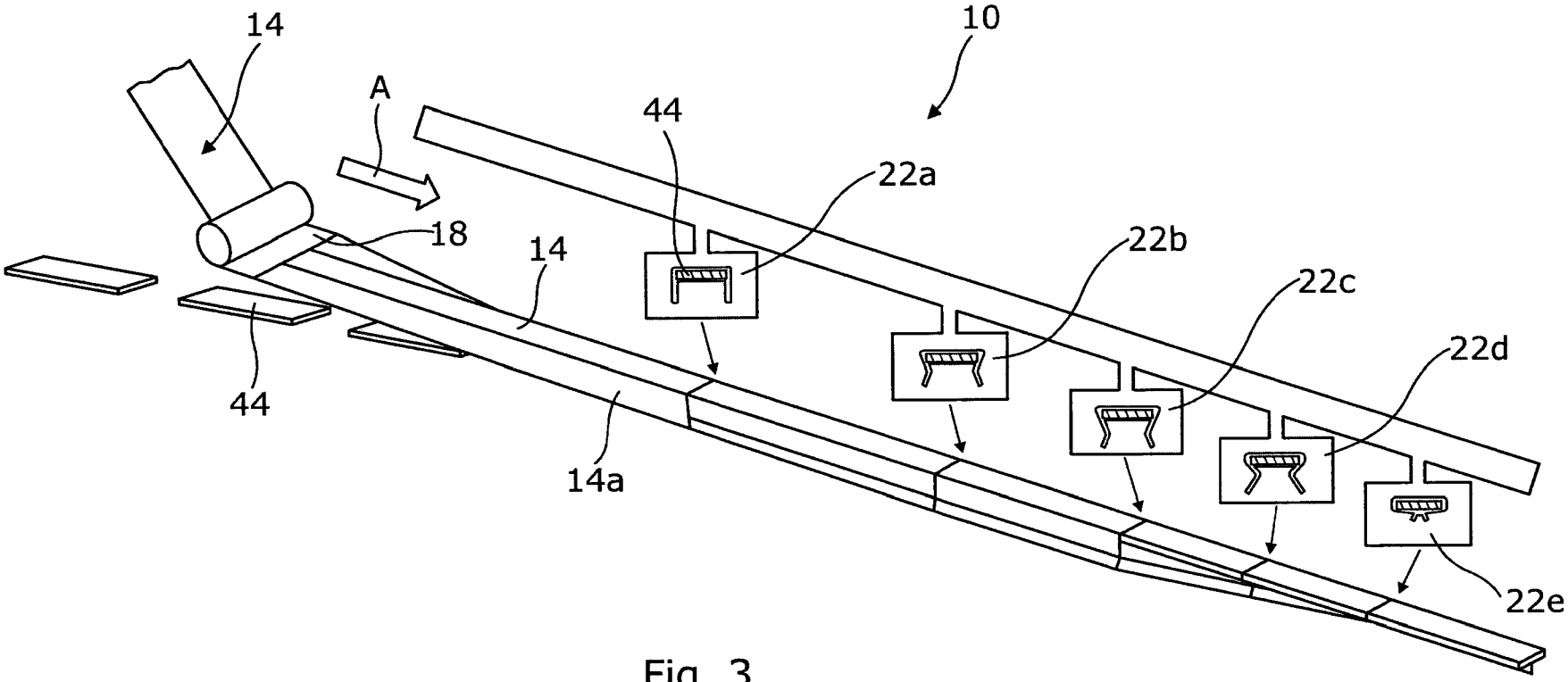
FIG. 3 is a still further schematic illustration of the apparatus of FIG. 1 exemplifying a second embodiment of an arrangement for introducing items into the packaging.

A first embodiment of an apparatus 10 and method for manufacturing packaging in accordance with aspects of the invention is illustrated in FIGS. 1 to 3.

The apparatus 10 comprises a packaging material dispenser (indicated generally at 12) to convey an initially flat strip of packaging material 14 in a packaging material conveyance or machine direction, which direction is indicated by arrow A.

The apparatus is particularly adapted for use with a semi-rigid packaging materials. The term "semi-rigid" refers to a material which can be folded about an item during packaging but which is sufficiently rigid that it exhibits dead-fold characteristics. The packaging material may be paperboard, cartonboard, cardboard, or a semi-rigid polymeric material, including combinations of such materials and laminated materials which include at least one layer of such materials. Cartonboard generally comprises multiple layers of fibres and may comprise at least three layers of fibres. The packaging material may comprise paperboard or cartonboard having a weight of 150 g/sqm or more and especially a weight in the range of 150 g/sqm to 250 g/sqm. However, the apparatus 10 could also be adapted for use with other semi-rigid materials including semi-rigid polymeric materials having a thickness of 150 μm or more, or a thickness of 200 μm or more.

The packaging material 14 is initially wound on a supply roll (not shown in FIGS. 1 to 3 but see 115 in FIG. 4 discussed below) and the packaging material dispenser 12 includes a mechanism for drawing the packaging material from the roll and conveying an unwound strip of the material in the machine direction A though a package forming section 20. The mechanism will typically include one or more rollers 16 for guiding and supporting the packaging material along the desired path and for maintaining a desired tension in the packaging material as is known in the art. The mechanism may include driving rollers which engage with the packaging material. However, the dispenser can comprise any suitable arrangements for dispensing the packaging material and conveying it through the package forming section.

In normal use, the packaging material is dispensed from the roll in a continuous length until the required packaging is complete or the roll is exhausted, in which case it is replaced and the process repeated. References herein to a "continuous" or "substantially continuous" length of packaging material should be understood in this context. The apparatus may have more than one supply roll which can be used alternately so that the material can be replaced with minimum down time.

The apparatus 10 is similar to a HFFS type packaging apparatus and the packaging material dispenser 12 guides the packaging material from the supply roll into a generally horizontal flow path in the machine direction A, with the packaging material in an initially planer configuration as shown at 18. The apparatus 10 includes the forming section 20 which is configured to gradually fold the packaging material from its initial planar configuration into a tube-like structure which encircles a target item. Depending on the shape and nature of the item being packaged and the type of packaging material used, the packaging material could be wrapped closely about the item so that it conforms to the cross-sectional shape of the item. However, in some applications the packaging material may be formed into a tube-like structure which surrounds the item, usually in relatively close proximity, but does not necessarily conform to its cross-sectional shape. This may be the case where the packaging material is too rigid to be able to conform to the shape of the item and/or where the item is irregular in shape. It should be understood that the term "tube-like" does not imply that the structure is cylindrical as the packaging material can be folded in to any suitable shape as required to enclose a particular item. This might include, without limitation, tube-like structures that are polygonal in cross-section and which could be rectangular, triangular or hexagonal in cross-section, for example. In some applications, the apparatus and methods of the invention could be used to from the packaging material in to a tubular package into which items are subsequently inserted.

In accordance with the invention, the forming section 20 includes a series of package formers 22*a* to 22*e* arranged in-line in the machine direction. Each of the package formers defines a packaging material folding channel 24 through which the packaging material passes as it travels in the machine direction A.

The packaging material folding channel 24 in each package former is configured to fold the packaging material 14 about a longitudinal axis X extending in the machine direction A as the packaging material is drawn towards and through the packaging material folding channel 24. The packaging material folding channels 24 of the package formers 22*a* to 22*e* in the series vary in shape so as to gradually and sequentially fold the packaging material 14 about the longitudinal axis X from its planar configuration into the tube-like structure about an item as it is conveyed through the series of pack formers in the machine direction A.

The package formers 22*a* to 22*e* can take a number of different forms. In the embodiment illustrated, each former comprises a planar, relatively thin plate 34 in which the packaging material folding channel 24 is provided by means of an aperture 36 through the plate. In FIGS. 1 to 3, the formers 22*a* to 22*e* are illustrated schematically in their relevant positions in the forming section but above the flow path of the packaging material and with their major faces and the apertures 36 facing out of the page so that the shapes of the apertures can be seen. It will be appreciated that in practice the formers 22*a* to 22*e* will be aligned with their major faces generally perpendicular to the machine direction A (that is say perpendicular to the direction in which the packaging material is conveyed through the forming section 20) with the apertures 36 arranged to open generally in-line with the machine direction A and each other so that the packaging material can be drawn sequentially through the apertures 36 in each of the plates.

In the embodiment illustrated, there are five package formers 22*a* to 22*e*. In the first former 22*a* in the series, the aperture 36 which defines the packaging material folding channel 24 is generally in the shape of an inverted "U" slot through which the packaging material alone passes. As the packaging material 14 is drawn towards and through this first package former 22*a*, side regions 14*a* of the material are folded downwardly so that the packaging material defines un upper or front panel 38 and the side panels 40 of the package. The following three package formers 22*b* to 22*d* have packaging material folding channels 24 which are shaped to gradually fold up parts of the side regions 14*a* to define the lower or back panel 42 of the package, with the outermost lateral edge regions 14*b* of the packaging material projecting outwardly. This process is completed by the packaging material folding channel 24 in the final package former 22*e*, where the outermost lateral edge regions 14*b* of the packaging material are moved to project outwardly in closely opposed relation. These longitudinally extending lateral outer edge regions 14*b* are subsequently sealed together to form a longitudinal fin seal of the package in a known manner. In an alternative embodiment, the longitudinal seal could be a lap seal in which the longitudinally extending lateral outer edge regions 14*b* overlap one another parallel to the lower or back panel 42 in a known manner. The shapes of the packaging material folding channels 24 can be modified to produce a lap seal, for example by being configured in the series so that the side region 14*a* and the lateral outer edge region 14*b* on a first side of the packaging material is folded inwardly and the side region 14*a* and the lateral outer edge region 14*b* on the other, second side is folded so that the lateral outer edge region 14*b* on the second side overlaps the lateral outer edge region 14*b* on the first side.

The use of a series of package formers 22*a* to 22*e* has a number of advantages over a single continuous former. It is easier to manufacture and set up a series of package formers 22*a* to 22*e* than attempting to produce a single continuous forming section. In many applications, the package formers, or at least those parts which are contacted by the packaging material, will be spaced apart in the conveyance direction A. This reduces friction compared with a conventional former of equivalent length having a continuous elongate sheet-like (expansive) surface over which the packaging material is drawn. This is particularly beneficial for use with semi-rigid packaging materials such as paperboard and cartonboard where it is expected that the length of the forming section 20 will be longer than that used in conventional flow-wrap HFFS apparatus adapted for use with flexible packaging films. In practice, the forming section 20 in apparatus in accordance with the invention may have a length (as measured in the machine direction A) of 1 metre or more, or 1.5 metres or more, or 2 metres or more or 3 metres or more. Alternatively, the length of the forming section can be related to the length and/or the width of the packages being produced, where the length of each package is measured in a longitudinal direction from transverse end seal to transverse end seal and the width is measured transversely. In this regard, the longitudinal direction of a package will be parallel to the machine direction A when a package is being conveyed through the apparatus. Considered in relation to the length of the package, forming section 20 could have a length which is at least 3 times the length of the package, or at least 4 times the length of the package, or at least 5 times the length of the package, or at least 6 times the length of the package. Whereas when considered in relation to the width of the package, the forming section 20 may have a length which is at least 7 times the width of the package, or at least 8 times the width of the package, or at least 9 times the width of the package, or at least 10 times the width of the package. Nevertheless, in general the length of the forming section 20 will be kept to a minimum consistent with the need to produce packages of an acceptable quality and in some applications the length of the forming section could be shorter than the examples given above.

The package formers are arranged so that the packaging material folding channels are aligned generally concentrically about the longitudinal axis X extending in the machine direction through the forming section 20. It should be noted that the packaging material dispenser 12 is arranged to align the packaging material 14 generally parallel to a plane parallel to the longitudinal axis X, and thus perpendicular to the package formers, before it contacts the first of the package formers 22*a*. The dispenser is also arranged to convey the packaging material through the forming section 20 with the upper panel 38 moving substantially in the same plane through all the package formers. In this regard it can also be said that the packaging material folding channels are aligned substantial in a common plane. In the present embodiment where the apparatus is a HFFS apparatus, the packaging material can be brought into a generally horizontal flow path before engaging with the first of the package formers with the upper panel 38 continuing on a generally horizontal path through the whole forming section. As a result, the packaging material is only folded by a significant amount in one direction or plane about the longitudinal axis as it passes through the forming section. This is especially advantageous for semi-rigid packaging materials, reducing its tendency to bulge or buckle. It will be appreciated that when producing packages of different shapes, there may not be an upper panel 38 but that at least part of the packaging material will pass through the forming section substantially in a single plane so that the packaging material is substantially folded in only one direction or plane at any given time. Regardless of the shape of the package formed, it is advantageous if the forming section is configured such that the packaging material is generally only folded about a longitudinal axis X extending in the direction in which the packaging material is conveyed.

It will be appreciated that the packaging material does not have to be held strictly perpendicular to the package formers so long as the change in angle of the packaging material in the machine direction is relatively small and does not cause unwanted bulging and creasing. Indeed, in some applications it may be desirable to bring the packaging material on to the first of the package formers 22*a* at a slight angle in order to control the tension in the material. However the angle will be significantly smaller than those used in conventional flow-wrapping apparatus and methods and will typically be no more than twenty degrees, or no more than ten degrees, or no more than five degrees, relative to a plane extending parallel to, or which contains, the machine direction. In tests on a HFFS type apparatus, it has been found that it can be advantageous to bring the packaging material onto the first of the package formers 22*a* at a slight upward incline from below.

It will be also appreciated that the number of package formers 22*a* to 22*e* and the spacing between them can be varied to suit the particular packaging material 14 used and the overall packaging requirements. Thus, in some packaging applications more or fewer than five package formers 22*a* to 22*e* can be used. An increased number of package formers would allow the packaging material to be folded in a larger number of incremental stages and with more support but would increase frictional resistance to the movement of the packaging material. The spacing between adjacent package formers, or at least between those parts that contact the packaging material such as those parts which define the packaging material folding channels 24, is selected to ensure that the packaging material does not sag too much between formers. Thus, for use with more rigid, stiffer materials, the spacing can be larger than for use with more flexible materials. The spacing between adjacent package formers 22*a*-22*e* need not be constant along the series. Thus as illustrated, the package formers later in the series may be closer together than those at the beginning of the series. Additional support for the packaging material could be provided between adjacent package formers.

In order to initiate operation of the apparatus, a leading end of the packaging material 14 may be fed by hand through the packaging material folding channels 24 in the package formers and manipulated into the correct shape to pass through each channel 24 in turn. Once the packaging material has been fed through all the package formers it can be run at a steady state in direction A, with the material 14 automatically conforming to the correct shape to pass through the respective packaging material forming/shaping channel 24 of each of the various package formers as it approaches them in turn. This is illustrated schematically in the attached drawings in which the various stages of folding the packaging material are shown below the respective package formers 22*a* to 22*e*.

The packaging material 14 may be scored or debossed to assist in folding. Scoring and debossing reduces the thickness of the packaging material to create a line of weakness along which the material can be more easily folded. Some score/debossing lines may extend longitudinally (i.e. in the machine or conveyance direction A) whilst some may extend laterally or at an angle between the two. The material 14 may be pre-scored/debossed before it is wound on the supply roll. Alternatively, or in addition, the apparatus 10 may include one or more arrangements for scoring/debossing the packaging material in-line after it has been drawn from the supply roll. A scoring/debossing arrangement may be provided upstream of the first package former 22*a* and/or between any pair of adjacent package formers. At least one of the package formers 22*a*-22*e* may also have sections which help with scoring/debossing the packaging material before or as it enters the packaging material folding channel. Scoring arrangements may include the use of mechanical die cutting technology and/or laser scoring. Debossing in-line could be carried out using mechanical pressing technology, such as by passing the packaging material between a pair of rollers or wheels that compress the material for example.

The packaging material could alternatively, or in addition, be pre-creased. Pre-creasing involves partly folding or manipulating the packaging material so that it has a permanent tendency to bend along a given line. The packaging material could be pre-creased before it is wound on the supply roll and/or the apparatus may include arrangements for pre-creasing the packaging material in the line but outside of the package formers. This might be carried out, for example, by passing the packaging material between a pair of male and female components that create a localised crease line.

The packaging material may be scored, debossed or pre-creased longitudinally at locations which form corners of the finished package. For example, if the package has a generally rectangular profile in cross-section, say for packaging a chocolate bar or other block shaped item, the packaging material 14 may be scored or pre-creased longitudinally at each corner of the rectangle. However, the packaging material can be scored, debossed or pre-creased longitudinally at any location where a fold line is required.

As illustrated schematically in FIGS. 2 and 3, the apparatus also includes an item conveyancing arrangement (not shown) for conveying a series of items 44 to be packaged in the machine direction and sequentially positioning the items proximal to the packaging material at a suitable location so that the packaging material is folded about each item in turn as it is formed into the tube-like structure. In essence, the item conveyancing arrangement inserts each item into the partially folded packaging material so that the item is passed together with the packing material through the packaging material folding channel in all the subsequent package formers, which complete the process of folding the packaging material completely about the item.

The item conveyancing arrangement can take any suitable form as is known in the art. Where the items are conveyed from below the packaging material 14, the item conveyancing arrangement could comprise elongate guides for supporting the items from below and along which the items can slide and a circulating drive belt or chain which over part of its length runs parallel to the guides. The drive belt or chain would typically have a number of drive members (e.g. pegs) spaced along its length, each being configured to engage an end of an item and move it in the machine direction along the guides such that the items are maintained at a set spacing from one another and moved along the guides at a speed which is co-ordinated with the speed of the packaging material. The guides can be arranged to support each item until the packaging material has been folded around it sufficiently that the packaging material is able to hold the item without the need for an item guide. In an embodiment, the packaging material will grip the item sufficiently tightly that it draws the item along though any remaining package formers 22. However, further item guides may be provided which contact the exterior of the packaging material below the item to support the weight of the packaged item where required.

FIG. 2 illustrates an embodiment in which the items 44 are introduced into the partially folded packaging material 14 at a location downstream from the first package former 22*a*. In the embodiment illustrated, each item 44 is inserted into the partially folded packaging material 14 just prior to the third package former 22*c*, at a position where the side regions 14*a* of the packaging material have been folded inwardly and upwardly to partially define the lower panel 42. This is advantageous as the item 44 is supported from the below by the side regions 14*a* of the packaging where they are folded inwardly so that the item is trapped between the upper panel 38 of the packaging material and the inwardly folded side regions 14*a*. The partially folded packaging material 14 with the item 44 partially encased is then passed through the packaging material folding channels 24 of the third, fourth and fifth package formers 22*c*, 22*d*, 22*e*, which complete the process of folding the side regions 14*a* upwardly below the item to fully form the lower panel 42. Once the item leaves the final package former 22*e*, it is fully wrapped in the packaging material 14, with the outermost lateral end regions 14*b* of the packaging material projecting outwardly from the lower panel. The outermost lateral end regions 14*b* are sealed together to form a longitudinal fin seal in the packaging which may be folded over to one side or the other in a known manner. The process of forming the longitudinal seal may be carried out, or at least initiated, whilst the item is still passing through the final package former 22*e* or it may be carried out after the item has left the final former. The apparatus 10 will include a suitable sealing mechanism for forming the longitudinal seal, such as are well known in the art. In order to complete the package, opposed regions of the packaging material are sealed together to form laterally extending transverse end seals at either end of the item, and the packaging material cut to separate each package from the remainder of the packaging material. The apparatus 10 will be provided with a suitable sealing mechanism to form the end seals, such as end sealing bars for crimping the packaging material as are known in the art.

FIG. 3 illustrates an alternative embodiment in which each item is inserted into the partially folded packaging material 14 just prior to it entering the packaging material folding channel 24 of the first package former 22*a* in the series. In this embodiment, each item will pass through the packaging material folding channels 24 of all of the package formers 22*a*-22*e* together with the packaging material. In this embodiment, the item may be supported from below until the packaging material is folded about the item sufficiently that it can support the time itself. In addition, supporting members could be provided which engage the outer surface of the packaging material below to continue to support the item as it continues to move through the forming section 20 even once it has been partially wrapped.

It will be appreciated that in either of the embodiments described above with reference to FIGS. 2 and 3, in the package formers downstream of the point at which the items are inserted into the partially folded packaging material, the apertures 36 which define packaging material folding channels 24 will be shaped to accommodate an item 44 at least partially encased in the packaging material. This is indicated in FIGS. 2 and 3 by the cross hatching within the relevant package formers (22*c*, 22*d*, and 22*e* in FIG. 2 and all the package formers in FIG. 3) which indicates the cross-sectional shape of the item 44. Typically, the packaging material folding channel 24 in the final package former 22*e* will have a shape which conforms to the cross-sectional shape of the item being packaged when fully encased in the packaging material and, where a longitudinal fin seal is produced, a suitable formation to accommodate the outermost lateral end regions 14*b* which form the fin seal. It should be appreciated that the items can be inserted into the partially folded packaging material at any suitable location along the series of package formers 22*a* to 22*e*.

In the embodiments illustrated in FIGS. 2 and 3, the items 44 are introduced into the partially folded packaging material 14 from below. However, it should be appreciated that process could be inverted and the items 44 fed in from above the packaging material in a top feeding arrangement.

At least some of the of package formers are configured so that they may contact both the outer 26 and inner surface 28 of the packaging material as it passes through the material folding channel 24 to support and guide the packaging material as it is being folded. In this regard, opposed surfaces of the package former which define the channel 24 can be regarded as an outer guide surface 30 for contact with the outer surface 26 of the packaging material and an inner guide surface 32 for contact with the inner surface 28 of the packaging material. However, in some arrangements at least the final package former 22*e* may only engage with the outer surface of the packaging material to complete the process of folding the material about an item. By engaging both sides of the packaging material, the package formers are able to accurately fold the packaging material into the required shape, even where the packaging material would be too rigid to readily conform to the shape of a conventional former which engages only one side of the material. Nevertheless. depending on the type of packaging material used, it is possible in some embodiments that only the outer surface of the packaging material contacts the package formers.

Reference to the "outer surface of the packaging material" in this context means the surface of the packaging material which is outermost when the packaging material is formed into a package. In contrast, reference to the "inner surface of the packaging material" means the surface which is innermost in the completed package and which is directed toward the packaged item.

FIGS. 4 to 14 illustrate a further embodiment of apparatus 110 for manufacturing flow-wrapped packaging in accordance with an aspect of the invention. The apparatus 110 of this second embodiment is similar to the apparatus 10 of the first embodiment described above and so only the major differences will be described in detail.

The apparatus 110 comprises a packaging material dispenser 112 arranged to dispense a continuous strip of packaging material 114 in a machine or packaging conveyance direction A. The packaging material 114 is initially wound on a supply roll 115 and the packaging material dispenser 112 includes a mechanism for drawing the packaging material from the roll into the conveyance or machine direction A. The mechanism will typically include one or more rollers 116 for guiding and supporting the packaging material along the desired path and for maintaining a desired tension in the packaging material. The packaging material is initially dispensed from the supply roll 115 in a flat or planar configuration 118 and the apparatus 110 has a forming section 120 through which the packaging material is conveyed and which is configured to fold the packaging material into a tube-like structure. As with the previous embodiment, the forming section 120 includes a series of five package formers 122*a* to 122*e* arranged in-line in the machine direction. Each of the package formers defines a packaging material folding channel 124 through which the packaging material passes as it travels in the machine direction A. The shapes of the channels 124 are configured to gradually and sequentially fold the packaging material from the planar state 118 into the tube-like structure.

Similar to those of the first embodiment, the package formers of the second embodiment each comprise a generally vertically extending plate 134 in which the packaging material folding channel 124 is defined by means of an aperture 136 through the plate. However, unlike the formers of the previous embodiment, each of the formers in the second embodiment additionally have one or more guides which extend upstream from an inlet side of the plate 134. The guide or guides on each package former are configured to lead the packaging material 114 towards and through aperture 136 in the plate and can be considered to define an extension of the packaging material folding channel 124.

As illustrated, in the package formers 122*a*-122*e* of this second embodiment, the vertical plate 134 is provided as part of an L-shaped member 152 having a horizontal base portion 154 at the lower edge of the plate 134 which base portion is mounted to a lower support structure 156. However, in practice the package formers could be supported from above and/or from one or more sides rather than from below as required to accommodate the item conveyancing arrangement which may convey items being packaged either from below or above the path of the packaging material.

Further details of the package formers 122*a*-122*e* will now be described with reference in particular to FIGS. 5 to 14.

Figure 4:
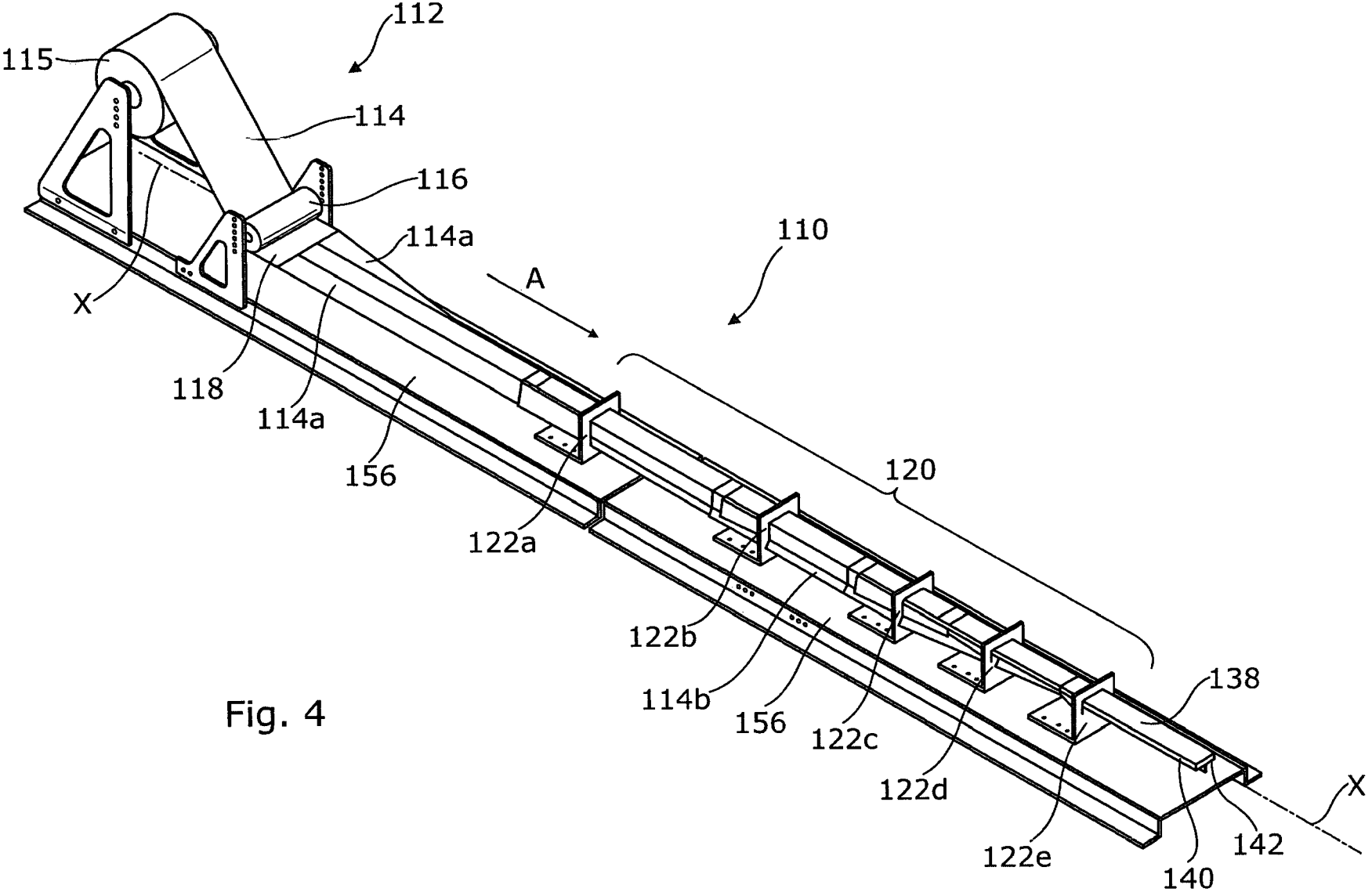
FIG. 4 is a perspective, partly schematic illustration showing a second embodiment of apparatus for manufacturing packaging in accordance with an aspect of the present invention.
Figure 5:
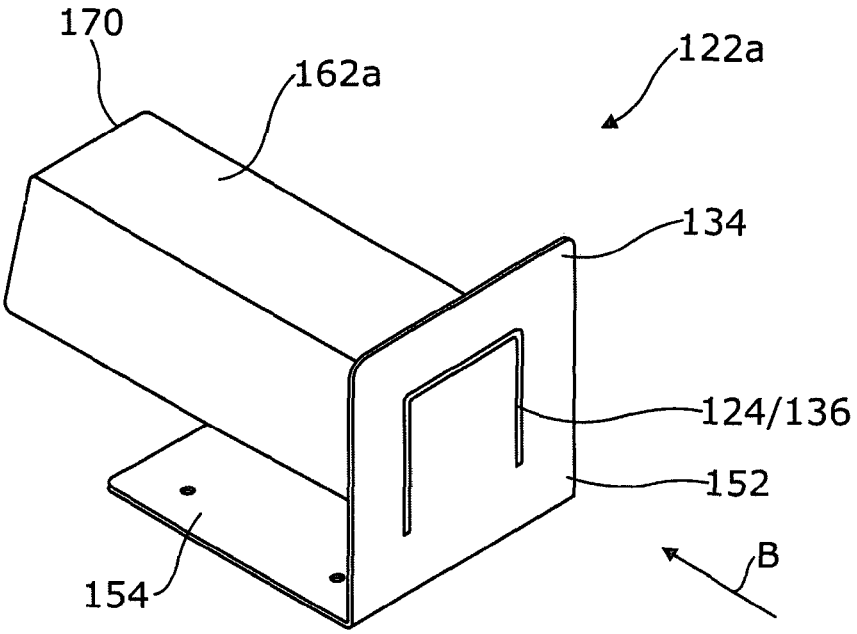
FIG. 5 is a perspective view of a first package former forming part of the apparatus of FIG. 4.
Figure 6:
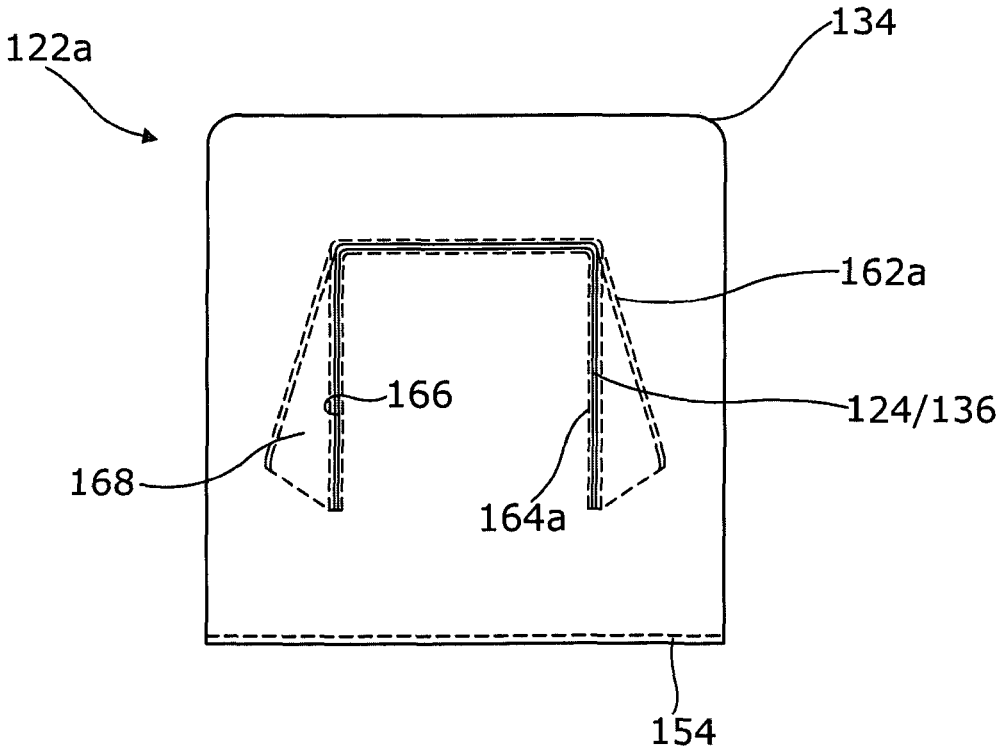
FIG. 6 is an end view of the first package former of FIG. 5 taken in the direction of arrow B in FIG. 5.
Figure 13:
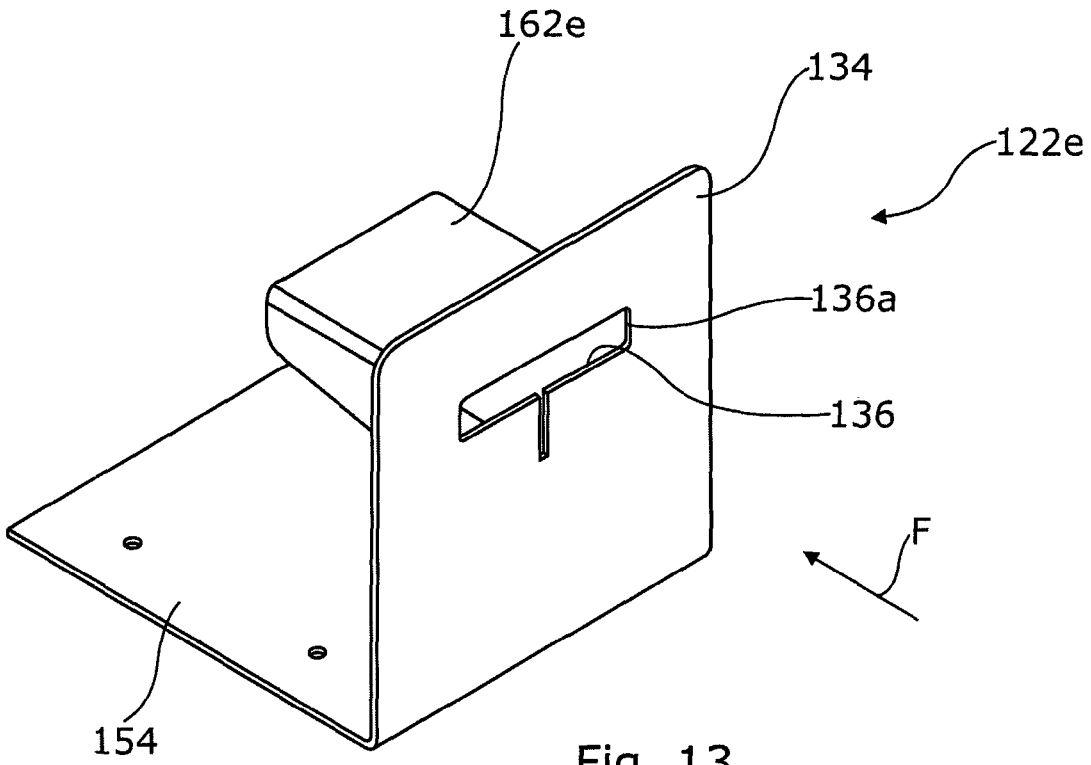
FIG. 13 is a perspective view of a fifth package former forming part of the apparatus of FIG. 4.
Figure 14:
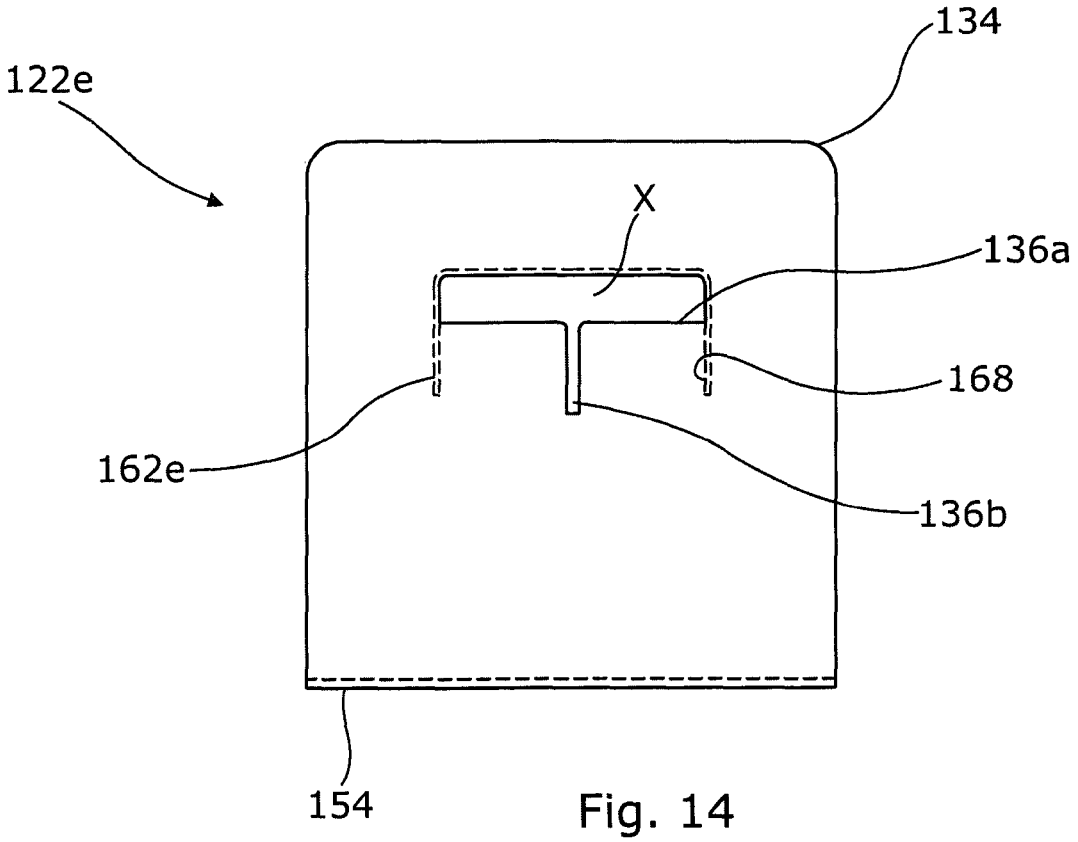
FIG. 14 is an end view of the fifth package former of FIG. 13 taken in the direction of arrow F in FIG. 13.

Although not illustrated in FIG. 4, the apparatus 110 will comprise an item conveyancing arrangement similar to that described above in relation to FIGS. 2 and 3. However, the apparatus 110 is configured so that items are introduced into the partially folded packaging material 114 just upstream of the final package former 122*e* in the series. Accordingly, the apertures 136 which define part of the packaging material folding channels 124 of the first four package formers 122*a*, 122*b*, 122*c* and 122*d* are in the form of relatively narrow slots through which the packaging material alone passes. The slotted apertures 136 in these package formers having a thickness which is substantially equal to or only slightly larger than the thickness of the packaging material 114. However, in the final former 122*e*, the aperture 136 is shaped to accommodate the packaging material wrapped about an item, which in the present embodiment has the shape of a rectangular block in cross-section, such as a chocolate bar. Accordingly, as shown in FIGS. 13 and 14, the aperture 136 has a rectangular main portion 136*a* sized to accommodate an item with the packaging material wrapped about it. In this embodiment, the package formers are configured to produce packages with a longitudinal fin seal. To accommodate this, the aperture 136 in the final former 122*e* also includes a vertical slot portion 136*b* which extends downwardly at the centre of the lower edge of the rectangular block-shaped main part 136*a* of the aperture through which the lateral outer edge regions 114*b* of the packaging material which form the fin seal pass.

Each of the first four package formers 122*a*, 122*b*, 122*c*, 122*d* has an outer guide 162 and an inner guide 164 projecting upstream (as considered in relation to the machine direction A in which the packaging material travels), from the upstream face of the plate 134. The inner and outer guides are elongate members having surfaces which contact the packaging material and are shaped so as to lead the packaging material into and through the aperture 136, with the outer guide 162 engaging with the outer surface 126 of the packaging material whilst the inner guide 164 engages with the inner surface 128 of the packaging material In each of the first four formers 122*a*, 122*b*, 122*c*, 122*d*, the inner guide 164 generally conforms to the shape of the slotted aperture 136, with an outer surface 166 of the inner guide 164 being aligned with an inner edge of the slotted aperture 136. Thus in the first former 122*a* which has an inverted U-shaped slotted aperture 136, the inner guide 164*a* is an elongate member having a corresponding inverted U-shape in cross-section so that the packaging material can be drawn onto and along the outer surface 166 of the inner guide to enter the slotted aperture 136. The inner guide 164*a* has a substantially constant cross-section along its length. The outer guide 162*a* in this package former is also of generally inverted U-shape having an inner surface 168 conforms generally to the shape of the outer edge of slotted aperture 136 adjacent the plate 134 but which flares outwardly towards an upstream end 170 of the guide 162*a*. The inner surface 168 of the outer guide contacts the outer surface 126 of the packaging material and acts as a funnel to direct the packaging material onto the inner guide 164*a* and into and through the slotted aperture 136.

Figure 7:
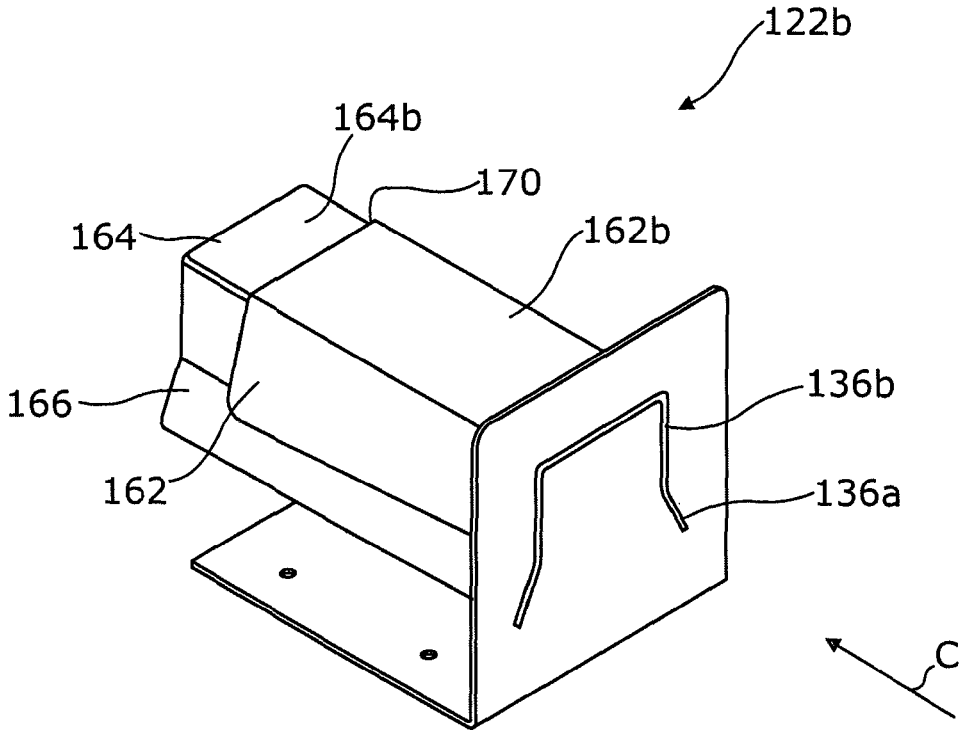
FIG. 7 is a perspective view of a second package former forming part of the apparatus of FIG. 4.
Figure 8:
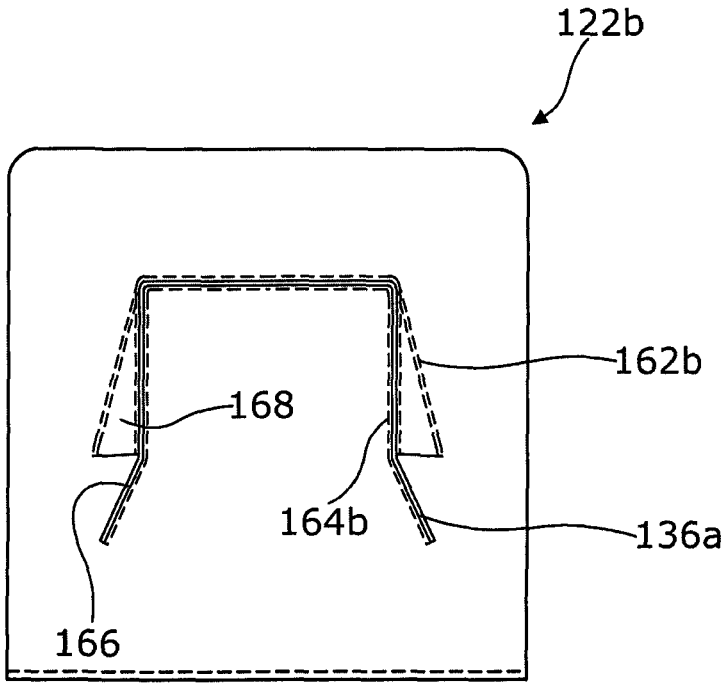
FIG. 8 is an end view of the second package former of FIG. 7 taken in the direction of arrow C in FIG. 7.
Figure 9:
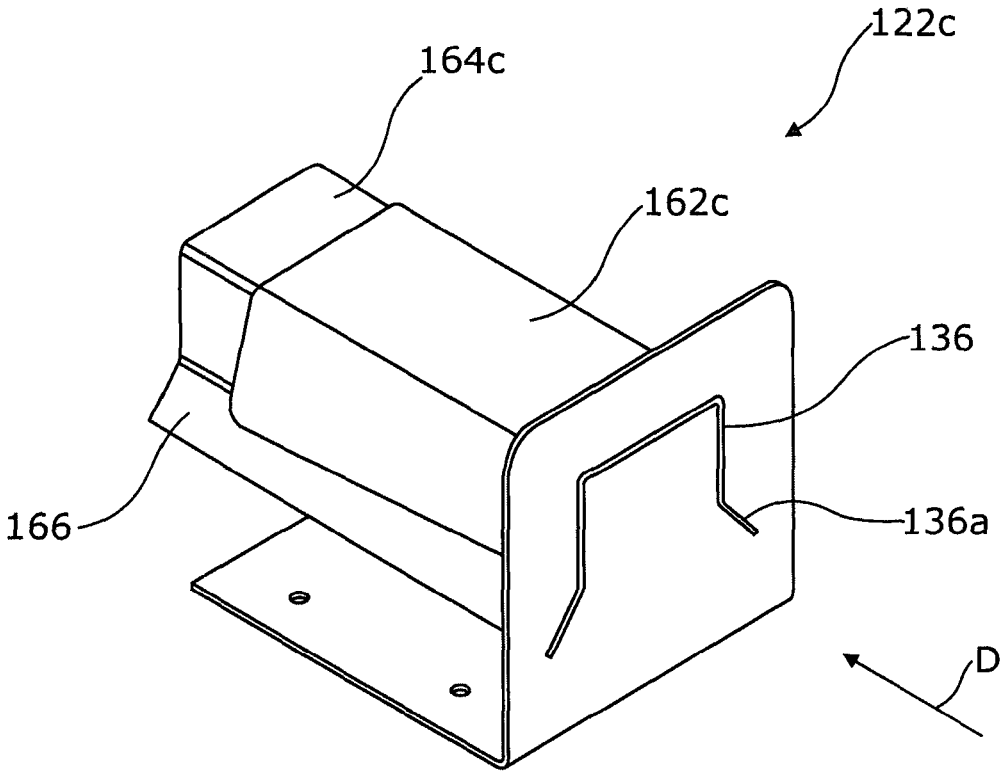
FIG. 9 is a perspective view of a third package former forming part of the apparatus of FIG. 4.
Figure 10:
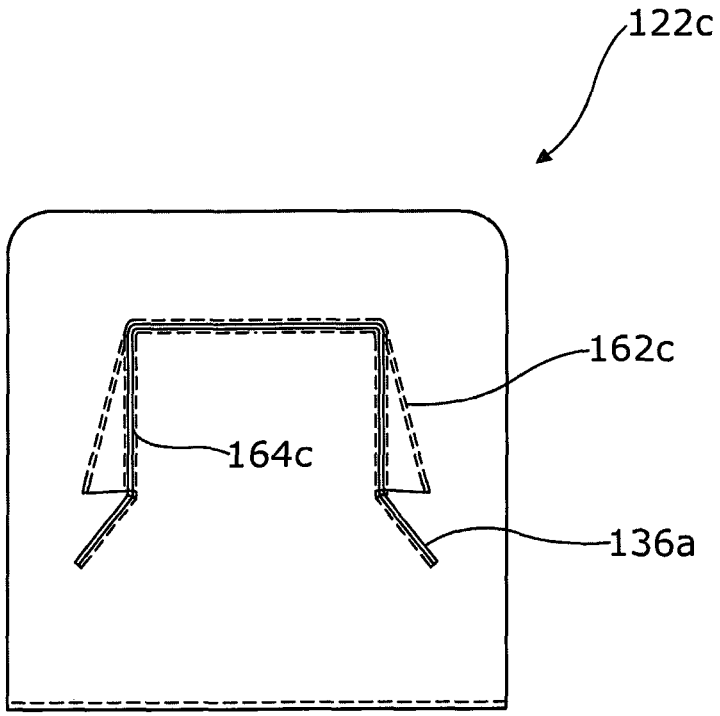
FIG. 10 is an end view of the third package former of FIG. 9 taken in the direction of arrow D in FIG. 9.
Figure 11:
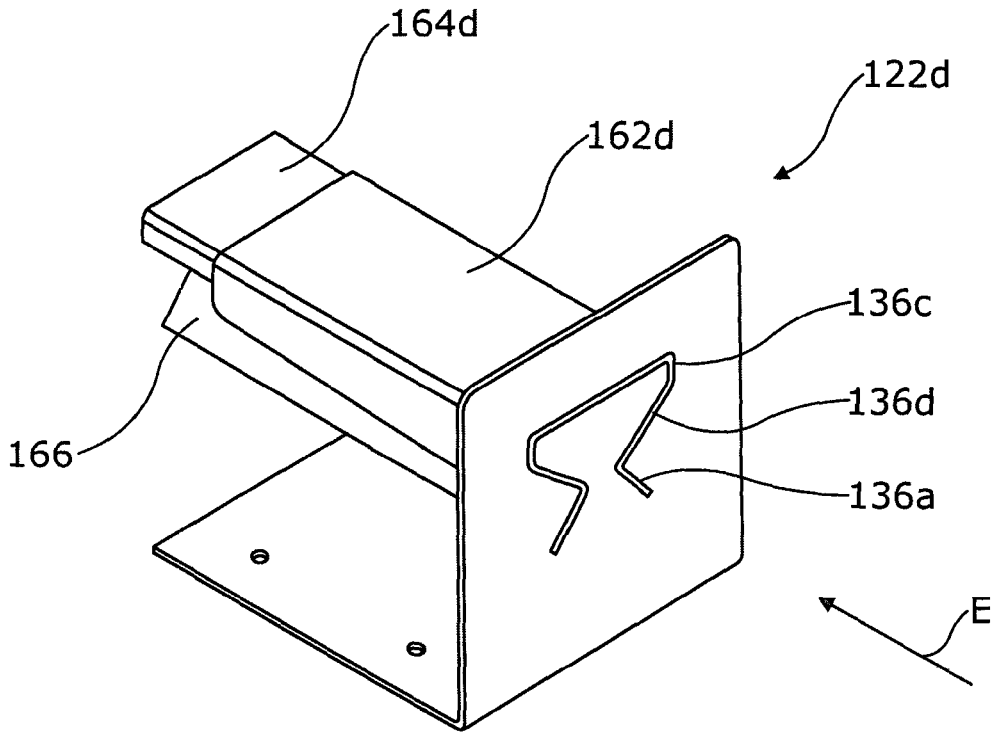
FIG. 11 is a perspective view of a fourth package former forming part of the apparatus of FIG. 4.
Figure 12:
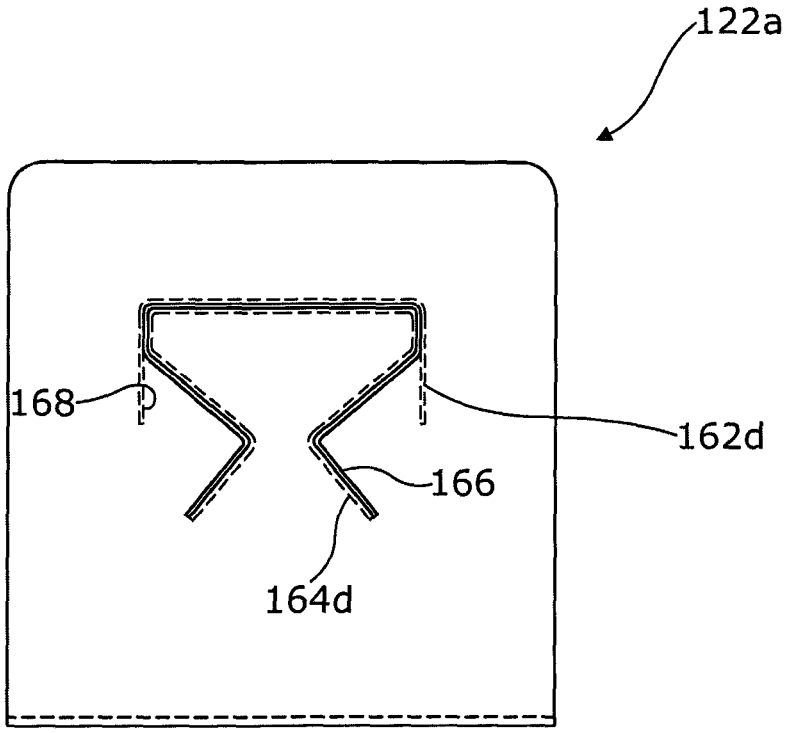
FIG. 12 is an end view of the fourth package former of FIG. 11 taken in the direction of arrow E in FIG. 11.

In the second package former 122*b* as illustrated in FIGS. 7 and 8, the aperture 136 is also generally shaped as an inverted U slot but lower end regions 136*a* of the side portions of the slotted aperture 136 are angled outwardly. This produces creases in the packaging material which define the inner edges of the outer lateral edge regions 114*b* of the packaging material which will form the longitudinal fin seal in the final packaging. The outer surface 166 of the inner guide 164*b* is shaped to conform to the inner edge of the slotted aperture 136 over its full length. The outer guide 162*b* in this former is a generally inverted U-shaped member having side portions which extend down only as far as the upper edge of the flared lower end regions 136*a* of the slotted aperture. The inner surface 168 of the outer guide 162*b* is shaped to conform to the profile of the outer edge of the slotted aperture 136 along the horizontal upper section of the slotted aperture and the vertically downwardly extending portions 136*b* but is flared outwardly towards the upstream end 170 of the guide. The inner guide 164*b* is longer than the outer guide 162*b*. The third package former 122*c* as shown in FIGS. 9 and 10 is similarly constructed, the only difference being that the lower end regions 136*a* of the slotted aperture are flared to a larger extent with a corresponding change to the shape of the inner guide 164*c*.

The aperture 136 in the fourth package former 122*d* is shaped so as to fold the side regions 114*a* of the packaging material upwardly and inwardly to start to define the side panels 140 and the lower or back panel 142 of the package. To this end, the side portions of the slotted aperture 136 have a generally vertically extending upper regions 136*c* which form the side panels 140 of the package, inwardly angled inner portions 136*d* which fold the packaging material inwardly so as to begin to form the lower or back panel 142 and the flared lower end regions 136*a* which further fold the outer lateral end regions 114*a* of the packaging material to produce a fin seal. The outer surface 166 of the inner guide

164*d* conforms to the profile of the inner edge of the slotted aperture 136 over its entire length. In this case, the outer guide 162*d* is an inverted U-shaped member whose inner surface 168 conforms to the outer edge of the horizontal upper part of the slotted aperture and the outer edges of the vertically extending upper edge regions 136*c* of the side portions of the slotted aperture. The outer guide 162*d* in this case is of generally constant cross-section and does not flare outwardly towards its upstream end.

The final package former 122*e* has only an outer guide 162*e*, which is similar in shape to the outer guide of the fourth former 122*d* as described above. Thus, the outer guide 162*e* is an inverted U-shaped member whose inner surface 168 conforms to the outer edge of the horizontal upper part of the slotted aperture and the outer edges of the vertically extending side portions 136*b* of the aperture 136. The outer guide 162*e* in this case is of generally constant cross-section and does not flare outwardly towards its upstream end. In this embodiment, the aperture 136 in the final former conforms to the lateral cross-sectional outer profile of the completed package containing the item with the outer lateral end regions 114*b* of the packaging material being in abutment. In this embodiment, the final former 122*e* only contacts the outer surface 126 of the packaging material.

In alternative embodiments, an inner and/or outer guide could be provided on the downstream side of the plate 152 of at least one of the package formers to support the packaging material leaving the aperture. Such downstream guides could be provided in addition to or instead of guides on the upstream side.

In the apparatus 110 as illustrated, each of the guides 162, 164 are formed from relatively thin sheet material shaped to define the required profile. However, this need not be the case and other arrangements for defining guide surfaces could be used. In this regard, the profiles of the outer surface 166 of the inner guide 164 and the inner surface 168 of the outer guide 162 are of primary significance. The lengths of the guides 162, 164 are configured to suitably support the packaging material. Accordingly, longer guides may be used where the packaging material is relatively flexible and shorter guides used where the packaging material is more rigid.

In the embodiments described, the package formers 22*a*-22*e*, 122*a*-122*e*, are separate components which are mounted to a support in spaced relationship. This is advantageous in that each former can be replaced independently. This can be beneficial if changes to one or more formers are found to be necessary. Also, the spacing between adjacent formers can be adjusted to suit particular requirements and the vertical position and/or orientation of each package former can be independently adjusted. However, it is possible that the formers, or at least some of the formers in the series, could be incorporated into a single integral unit and so may not be separate components as such. Nevertheless, it is expected that in many applications there will be separation between those parts of the adjacent package formers which contact the packaging material, such as those parts which define the guide channels 24, 124, including any guides 162, 164 where present. Accordingly, unlike conventional formers, the series of package formers will generally define a discontinuous guide surface rather than a continuous surface which contacts a significant surface area of the packaging material over which the packaging material is drawn as it is folded from a planer configuration into a tube-like configuration.

The packaging material 14, 114 can be sealed to form the completed package by any suitable means depending on the type of material and other packaging requirements. For example, the packaging material may be sealed using an adhesive such as, but not limited to, a heat sealable polyethylene (PE), a PE EVA blend, a PE EVA Ionomer blend, heat sealable polylactic acid copolymer or cold seal. The packaging material could be heat sealed using ultrasonic or radio frequency techniques or sealed using pressure where a cold seal is employed, for example. Indeed, any suitable sealing technique known in the art can be used. The packaging material may have sealing materials pre-applied or comprise a heat sealable layer as part of a lamination. Alternatively, or in addition, the apparatus may incorporate a system for applying adhesive or other sealing materials to the packaging material 14, 114 after it has been drawn from the supply roll at any suitable location in the line. The packaging material 14, 114 may also be printed on and/or be covered with a protective layer such as a coating of lacquer. Accordingly, reference to packaging materials comprising paperboard, cartonboard, cardboard, or paper and the like should be understood as including combinations of such materials, laminations including at least one layer of such materials, and packaging materials to which adhesive or other materials for forming seals have been applied, which may be printed on or coated with a protective layer. The packaging material may also include metal or metallised layers which provide barrier properties and/or which allow for induction heating. Other suitable barrier layers could also be included in the packaging material.

The apparatus and method of the invention are particularly suited to packaging items or articles which retain their shape as the packaging material is formed into a tube about them during packaging. Such items are referred to as rigid, in comparison to flowable items which conform to the shape of the packaging. For products that are rigid, these may be packaged using the apparatus and method of the invention directly, with no internal packaging, although internal packaging could be used if desired. This includes a wide range of products, including block-like products in the form of bars, which might include candy bars, chocolate bars, and other snack type bars, for example. However, products which are not block shaped can also be packaged using the apparatus and method of the invention. For example, chocolate or candy products in prismatic shapes other than a block can be packaged using the apparatus and method of the invention. This might include elongate products which are shaped as triangular or hexagonal prisms. Confectionary products having an irregular shape can also be packaged using apparatus and methods of the invention. This might include products shaped like an animal or other character, for example. Other food products which are solid at the temperatures experienced during packaging can also be packaged using the apparatus and method of the invention. For example, some cheeses, cakes and biscuits could be packaged using the apparatus and method of the invention. Products which are not themselves rigid or sufficiently robust to be packaged directly could be placed in a generally rigid container and the flow-wrapped package formed about the filled container using the apparatus and/or method of the invention. This might include products such as biscuits or crackers or the like which whilst rigid are not sufficiently robust to be flow-wrapped directly and where it is usual to package a plurality of the products together in a single package. In this case, a plurality of the products may be grouped (stacked) together in a rigid container to form a packaging item. Whilst the apparatus and methods of the invention are particularly suitable for packaging food products, they are not limited to such an application and can be adapted for packaging any suitable product.

It should also be understood that reference to an item being packaged in accordance with the apparatus or method according to the invention is intended to cover circumstances where more than one product piece are packaged together in a single package. For example, it is known to package two or more chocolate bars in a single package and the apparatus and method of the invention can be adapted to package multiple products grouped together in a single package in this way, with each group of products packaged together being considered an item.

In an embodiment, the apparatus 10, 110 includes an arrangement for moistening and/or heating the packaging material to make it easier to fold. This may comprise apparatus for applying steam and/or moist hot air to the packaging material. For example, at least some of the package formers could be housed in a chamber and the apparatus have a system for injecting steam and/or moist hot air into the chamber. Alternatively, or in addition, a pre-treatment chamber for moistening the packaging material can be located upstream of the package formers through which the packaging material is conveyed before passing through the package formers. The apparatus could have one or more nozzles for directing steam and/or moist hot air on to the packaging material and/or at least one of the package formers may incorporate a heating arrangement for heating the packaging material in use.

The above embodiments are described by way of example only. Many variations are possible without departing from the scope of the invention as defined in the appended claims. For example, the package formers 22*a*-22*e*, 122*a*-122*e* could take forms other than plates with apertures to define the packaging material folding channels 24, 124. A package former may comprise a body other than a plate in which an aperture to at least partially define the package material folding channels is provided. In a further exemplary alternative embodiment, a package former could comprise two separate guide members profiled and spaced apart to define a packaging material folding channel 24, 124 between them. It will be appreciated that the package formers in the series need not all be constructed the same. Furthermore, the package formers could be provided with low friction inserts or rollers or other formations, or be coated with a low friction material to assist the packaging material flowing through the channels smoothly. In some cases, the shape of the packaging material folding channel in a package former could vary in the conveyance direction A. The forming section could include arrangements other than the package formers to help fold the packaging material into a tube-like structure. Furthermore, the packaging material dispenser 12, 112 could include one or more mechanisms for driving the packaging material located between the first and the last package former.

The invention claimed is:

1. An apparatus for producing tubular packages sequentially from an initially generally flat length of packaging material, each package enclosing one of a series of items which are conveyed through the apparatus in a machine direction, the apparatus comprising:

a packaging material dispenser arranged to dispense a length of packaging material and convey the packaging material in the machine direction in use; and, a forming section through which the packaging material is conveyed in the machine direction, the forming section being configured to fold the packaging material from an initially flat configuration into a tubular package structure, the forming section comprising a series of package formers, each package former defining a packaging material folding channel through which the packaging material is conveyed, in use;

wherein the packaging material folding channels of the package formers in the series vary in shape such that, in use, packaging material passing through the series of package formers is gradually folded about a longitudinal axis extending in the machine direction, and wherein at least one of the package formers comprises a plate, in which the packaging material folding channel is defined at least in part via an aperture through the plate.

2. The apparatus as claimed in claim 1, wherein at least one of the package formers in the series is configured to engage both an outer and an inner surface of the packaging material as the packaging material passes through the packaging material folding channel.

3. The apparatus as claimed in claim 1, wherein the packaging material dispenser system is configured to introduce the packaging material to the packaging material folding channel of a first of the package formers in the series in a direction which is angled at no more than twenty degrees, or no more than ten degrees, or no more than five degrees, relative to a plane parallel to, or which contains, the longitudinal axis.

4. The apparatus as claimed in claim 3, wherein the packaging material dispenser is configured to introduce the packaging material to the packaging material folding channel of a first of the package formers in the series in a direction substantially parallel to a plane parallel to, or which contains, the longitudinal axis.

5. The apparatus as claimed in claim 1, wherein the apparatus further comprises an item conveyancing arrangement for conveying a series of items to be packaged in the machine direction and sequentially introducing each item proximal to the packaging material at a location such that, in use, the packaging material is subsequently folded about the item.

6. The apparatus as claimed in claim 5, wherein said location is downstream of at least a first one of the package formers and upstream of at least a last one of the package formers.

7. The apparatus as claimed in claim 5, wherein the apparatus is configured such that in use, each item is conveyed together with the packaging material through the packaging material folding channel of the package formers downstream of said location.

8. The apparatus as claimed in claim 5, wherein the packaging material folding channels of the package formers in the series downstream of said location are shaped to accommodate both the packaging material and an item located within the at least partially folded packaging material.

9. The apparatus as claimed in claim 1, wherein the package formers, or at least those parts of the package formers which contact the packaging material in use, are spaced apart in the machine direction.

10. The apparatus as claimed in claim 1, wherein the packaging material is a semi-rigid packaging material.

11. The apparatus as claimed in claim 1, wherein at least one of the package formers is adjustable to vary the height and/or the angle of the packaging material folding channel relative to at least one other of the package formers.

12. The apparatus as claimed in claim 1, wherein said at least one of the package formers has one or more guide formations for guiding the packaging material into and/or out of the aperture.

13. The apparatus as claimed in claim 1, wherein the plate extends transversely to the machine direction and the packaging material passes through the aperture in the plate.

14. The apparatus as claimed in claim 1, wherein the aperture is entirely bounded by the plate.

15. The apparatus as claimed in claim 1, wherein the plate is a first plate and that the aperture therethough is a first aperture, wherein another of the package formers comprises a second plate in which the packaging material folding channel is defined at least in part via a second aperture through the second plate, wherein the first aperture is entirely bounded by the first plate, wherein the second aperture is entirely bounded by the second plate, and wherein the first aperture differs in shape from the second aperture.

16. A method of manufacturing tubular packages sequentially from an initially generally flat length of packaging material, each package enclosing one of a series of items which are conveyed in a machine direction, the method comprising:

dispensing a length of packaging material and conveying the packaging material in the machine direction;

folding the packaging material into a tube-like structure by passing the packaging material through a forming section including series of package formers arranged in the machine direction, each package former comprising a packaging material folding channel through which the packaging material is conveyed;

wherein the packaging material folding channels of the package formers in the series vary in shape so as to gradually fold the packaging material about a longitudinal axis extending in the machine direction as the material passes through the series of package formers, and wherein at least one of the package formers comprises a plate, in which the packaging material folding channel is defined at least in part via an aperture through the plate.

17. The method as claimed in claim 16, the method comprising at least one of the package formers in the series contacting both an outer surface and an inner surface of the packaging material as the packaging material passes through its packaging material folding channel.

18. The method as claimed in claim 16, wherein the method comprises introducing the packaging material to the packaging material folding channel of a first of the package formers in a direction which is angled at no more than twenty degrees, or no more than ten degrees, or no more than five degrees, relative to a plane parallel to, or which contains, the longitudinal axis.

19. The method as claimed in claim 18, wherein the method comprises introducing the packaging material to the packaging material folding channel of a first of the package formers in a direction substantially parallel to a plane parallel to, or which contains, the longitudinal axis.

20. The method as claimed in claim 16, the method comprising introducing an item to be packaged into the partially folded packaging material upstream of at least one of the package formers and subsequently passing said item together with the partially folded packaging material through the packaging material folding channel of said at least one of the package formers to further fold the packaging material around the item.

21. The method as claimed in claim 20, wherein the method comprises introducing said item into the partially folded packaging material at a location upstream of a first one of the package formers in the series so that said item is passed together with the partially folded packaging material through the packaging material folding channel of each of the package formers in the series.

22. The method as claimed in claim 21, wherein the method comprises introducing said item into the partially folded packaging material at a location downstream of at least a first one of the package formers in the series so that said item is passed together with the partially folded packaging material through the packaging material folding channel of each of the package formers in the series downstream of said location.

* * * * *